US010675685B2

(12) United States Patent
Wusatowska-Sarnek et al.

(10) Patent No.: US 10,675,685 B2
(45) Date of Patent: Jun. 9, 2020

(54) METHOD FOR PREVENTING POWDER DEPLETION/CONTAMINATION DURING CONSOLIDATION PROCESS

(71) Applicant: UNITED TECHNOLOGIES CORPORATION, Farmington, CT (US)

(72) Inventors: Agnieszka M Wusatowska-Sarnek, Mansfield Center, CT (US); Larry G Housefield, Portland, CT (US); Ruston M Moore, Clinton, NY (US); Enrique E Montero, Marlborough, CT (US); Promila Bhaatia, Farmington, CT (US)

(73) Assignee: Raytheon Technologies Corporation, Farmington, CT (US)

( * ) Notice: Subject to any disclaimer, the term of this patent is extended or adjusted under 35 U.S.C. 154(b) by 952 days.

(21) Appl. No.: 15/111,588

(22) PCT Filed: Jan. 14, 2015

(86) PCT No.: PCT/US2015/011282

§ 371 (c)(1),
(2) Date: Jul. 14, 2016

(87) PCT Pub. No.: WO2015/108891

PCT Pub. Date: Jul. 23, 2015

(65) Prior Publication Data

US 2016/0332230 A1 Nov. 17, 2016

Related U.S. Application Data

(60) Provisional application No. 61/927,028, filed on Jan. 14, 2014.

(51) Int. Cl.

| | |
|---|---|
| ***B22F 3/12*** | (2006.01) |
| ***C23C 4/08*** | (2016.01) |
| ***C23C 28/02*** | (2006.01) |
| ***C23C 18/12*** | (2006.01) |
| ***B22F 3/20*** | (2006.01) |
| ***C22C 1/04*** | (2006.01) |
| ***C23C 4/18*** | (2006.01) |
| ***B22F 3/03*** | (2006.01) |
| ***C25D 7/04*** | (2006.01) |

(52) U.S. Cl.

CPC ..... *B22F 3/1241* (2013.01); *B22F 3/03* (2013.01); *B22F 3/1208* (2013.01); *B22F 3/20* (2013.01); *C22C 1/0433* (2013.01); *C23C 4/08* (2013.01); *C23C 4/18* (2013.01); *C23C 18/127* (2013.01); *C23C 18/1254* (2013.01); *C23C 28/021* (2013.01); *C23C 28/023* (2013.01); *C25D 7/04* (2013.01); *B22F 2999/00* (2013.01)

(58) Field of Classification Search

CPC .. B22F 3/12; B22F 3/1241; B22F 3/03; B22F 3/1208; B22F 3/20; C22C 1/0433; C23C 4/08; C23C 4/18; C23C 7/04

USPC ..... 419/38

See application file for complete search history.

(56) References Cited

U.S. PATENT DOCUMENTS

| | | | |
|---|---|---|---|
| 4,094,672 | A | 6/1978 | Fleck et al. |
| 4,212,669 | A | 7/1980 | Veeck et al. |
| 5,361,477 | A | 11/1994 | Semiatin et al. |
| 9,399,258 | B2 | 7/2016 | Bampton |
| 2004/0081572 | A1 | 4/2004 | Bampton et al. |
| 2008/0115358 | A1 | 5/2008 | Rice et al. |
| 2008/0166255 | A1 | 7/2008 | Yang et al. |
| 2009/0269605 | A1 | 10/2009 | Warke et al. |
| 2011/0052441 | A1 | 3/2011 | Goller et al. |
| 2011/0058975 | A1 | 3/2011 | Bampton |
| 2012/0085811 | A1 | 4/2012 | Warke et al. |
| 2016/0243621 | A1 | 8/2016 | Lucas et al. |

FOREIGN PATENT DOCUMENTS

| | | | |
|---|---|---|---|
| EP | 3057729 | A1 | 8/2016 |
| GB | 1426619 | A | 3/1976 |
| GB | 2027060 | A | 2/1980 |
| JP | 04-272186 | A | 9/1992 |
| JP | 06-017484 | B2 | 3/1994 |
| JP | 07-080072 | B2 | 8/1995 |
| JP | 08-176612 | A | 7/1996 |
| WO | 2015057761 | A1 | 4/2015 |

OTHER PUBLICATIONS

Supplementary European Search Report dated Aug. 11, 2017 for European Application No. 15737740.

International Search Report for PCT/US2015/011282 dated Apr. 24, 2015.

*Primary Examiner* — Edward M Johnson

(74) *Attorney, Agent, or Firm* — Bachman & LaPointe, P.C.

(57) ABSTRACT

A method for preventing powder depletion/contamination during a consolidation process provides a can for holding a powdered material; the can having an interior wall; a protective layer is positioned intermediate the powdered material and the interior wall utilizing a sol-gel process utilizing monodisperse nanopowders; and the protective layer being formed from a material selected from the group consisting of nickel alloys, chrome alloys, and combinations thereof.

5 Claims, 2 Drawing Sheets

METHOD FOR PREVENTING POWDER DEPLETION/CONTAMINATION DURING CONSOLIDATION PROCESS

CROSS REFERENCE TO RELATED APPLICATION

This application claims the benefit of provisional application Ser. No 61/927,028, filed Jan. 14, 2014.

BACKGROUND

The present disclosure relates to a system and a method for preventing powder depletion/contamination during a consolidation process.

To make a superalloy billet utilizing the powder metallurgy route, a powder of given composition is introduced through the opening in an inert container (can), which ultimately will undergo compaction and extrusion at high temperature. The can is typically made out of a higher grade stainless steel tube with lids welded to it. The tube can be either a centrifugally cast tube, or a rolled one from a sheet and welded. The can protects the powder from the environment and, in addition, it acts to provide self-lubrication during the extrusion process.

The primary purpose of using a higher grade stainless steel is to minimize the effect of chemical composition dissimilarity of materials (can and powder). Compositional differences between the can and the powder drive diffusion reactions during the compaction and extrusion steps resulting in a zone of alloy depletion/contamination to a depth of approximately 0.0250" in the powder. The depleted zone may be further disturbed during the in-process manipulation (handling or thermal shock), it may crack and the crack becomes filled with the depleted particles that further deteriorate the quality of the billet. Such areas will be revealed by a macro-etch method during the quality inspection of the billet—they will appear as etching lines generally aligned with the billet axis and progressing radially inward, therefore they are called linear etch indications (LEI).

Since LEIs have the potential of yielding non-uniform properties they must be removed which results in lower yields of the consolidated billet. Occasionally, LEIs may be undetected in the billet and carried further in the process to be detected only at the final stage of component manufacturing (resulting in scrap). There is a significant financial impact in lower yield and scrap.

SUMMARY

In accordance with the present disclosure, there is provided a system for preventing powder depletion/contamination during consolidation process, which system broadly comprises a can for holding a powdered material, which can has an interior wall, a protective layer positioned intermediate the powdered material and the interior wall; and the protective layer being formed from a material selected from the group consisting of nickel alloys, chrome alloys, and combinations thereof.

In another and alternative embodiment, the can may be formed from a steel material.

In another and alternative embodiment, the powdered material may comprise a nickel based superalloy.

In another and alternative embodiment, the protective layer may be formed from a nickel alloy.

In another and alternative embodiment, the protective layer may be formed from a chrome alloy.

Further, in accordance with the present disclosure, there is provided a method for preventing powder depletion/contamination during a consolidation process, which method broadly comprises the steps of: providing a can having an inner wall, lining the inner wall of the can with a protective layer formed from a material selected from the group consisting of a nickel alloy, a chrome alloy, and combinations thereof, placing a powdered material in the can so that the powdered material is in contact with the protective layer, and subjecting the can with the powdered material and the protective layer to a consolidation process.

In another and alternative embodiment, the can providing step may comprise providing a can formed from a steel material.

In another and alternative embodiment, the powdered material placing step may comprise placing a powdered nickel based superalloy material in the can.

In another and alternative embodiment, the lining step may comprise forming the lining on the inner wall by one of the following techniques; cladding, electroplating, plasma spraying, and sol-gel process utilizing monodisperse nanopowders.

In another and alternative embodiment, the lining step may comprise lining the inner wall with a nickel alloy.

In another and alternative embodiment, the lining step may comprise lining the inner wall with a chrome alloy.

Other details of the system and method for preventing powder depletion/contamination during consolidation process are set forth in the following detailed description and the accompanying drawings, wherein like reference numerals depict like elements.

DETAILED DESCRIPTION

The purpose of the system and method described herein is to minimize the formation of the undesirable phases, or depletion of the powdered material from the compositional elements during powder consolidation and extrusion due to the chemical dissimilarity of the can and powder compositional elements.

Figure 1:
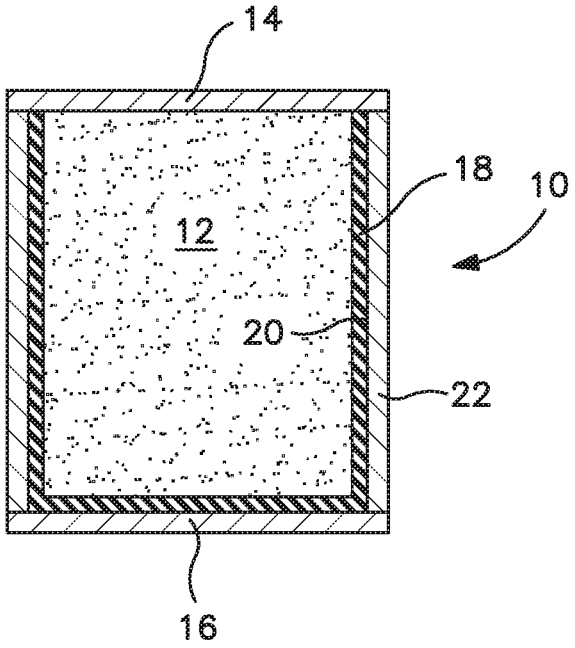
FIG. 1 is a schematic representation of a container to be used in a consolidation process.

Referring now to FIG. 1, there is shown a can 10 containing powder compositional elements 12. The can 10 may be formed from any suitable material known in the art, such as steel. The steel forming the can 10 may be a carbon steel. Other exemplary steel alloys which may be used to form the can 10 are 304 stainless steel or 321 stainless steel.

The can 10 may comprise a tube 22 with lids 14 and 16 and a protective layer or liner 18 joined to the tube 22. The tube 22 may be a centrifugally cast tube or a rolled tube formed from a sheet of material and welded along a seam (not shown).

The powder composition elements 12 may be the elements needed to form a nickel based superalloy, a cobalt based superalloy, or another nickel or cobalt based alloy.

The can 10 is provided with the protective layer or lining 18 between an interior wall 20 of the can 10 and the powder compositional elements 12. The protective layer or liner 18 may be formed from a nickel alloy material, such as Nickel 200, IN100, and Inconel 600, or one of a chrome alloy and a commercially pure chromium.

The protective layer or liner 18 may be applied to the inner wall 20 via one of cladding, electroplating, plasma spraying, sol-gel process utilizing monodisperse nanopowders, and a liner made of the nickel alloy.

One of the advantages to using a protective layer or lining 18 is that one can form the can 10 from a lower grade stainless steel if desired, rather than a high grade stainless steel material. For example, one could form the can 10 from a carbon steel.

If desired, the protective layer or lining 18 may be formed by plasma spraying of a Ni—Cr powder onto the inner wall 20.

Using the protective layer or lining 18, one can address the occurrence of LEI in the can 10 and avoid having to machine of layers of contaminated material from every log or billet formed from the powder metallurgy process. The protective layer or lining 18 acts as a means for preventing powder depletion/contamination during the consolidation process.

Figure 2:
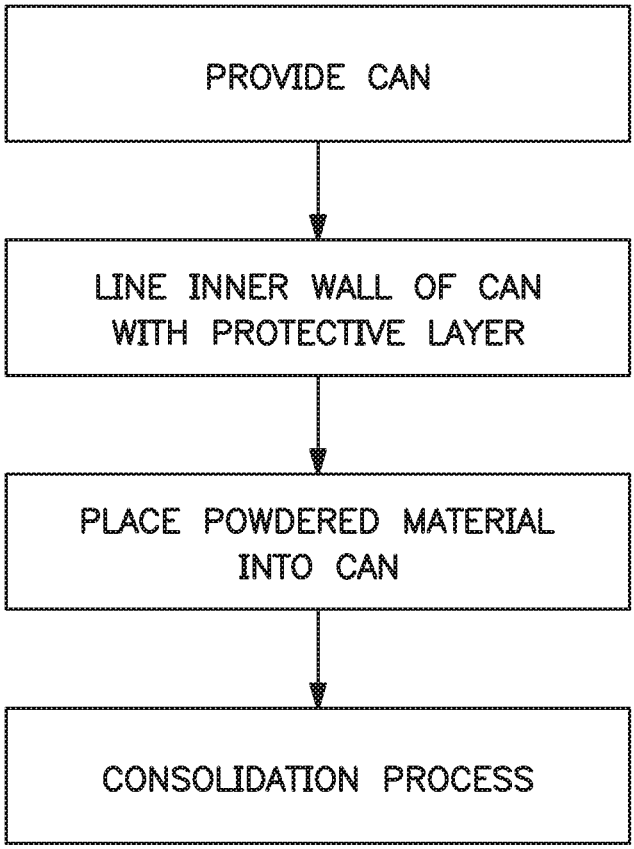
FIG. 2 is a flow chart illustrating a method for preventing powder depletion/contamination during a consolidation process.

Referring now to FIG. 2, the method for preventing powder depletion/contamination during a consolidation comprises providing a can 10 having an inner wall 20. Thereafter, the inner wall 20 is lined with a protective layer or lining 18 formed from a material selected from the group consisting of a nickel alloy, a chrome alloy, and combinations thereof. After the protective layer or lining 18 has been formed, the lids 14 and 16 may be attached to the can 10.

Then, the powdered compositional elements 12 are placed in the can 10 by introducing the powdered compositional elements 12 through an opening (not shown) in the can 10. The powdered compositional elements 12 are placed in the can 10 so that they are in contact with the protective layer 18.

Thereafter, the can 10, with the powdered compositional elements 12 therein and the protective layer 18, is subjected to a consolidation process, such as compaction and extrusion at high temperature.

While the system and method described herein have been described in the context of nickel based superalloys or nickel based alloys, the system and method described herein could be applied to any combination of metallic alloy powder and metallic can material that has an issue with depletion or contamination of powder due to diffusion of elements between the alloy powder and can material.

There has been provided a system and method for preventing powder depletion/contamination during a consolidation process. While the system and method for preventing powder depletion/contamination during a consolidation process has been shown in the context of specific embodiments thereof, other unforeseeable modifications, variations, and alternatives may become apparent to those skilled in the art having read the foregoing description. Accordingly, it is intended to embrace those alternatives, modifications, and variations as fall within the broad scope of the appended claims.

What is claimed is:

1. A method for preventing powder depletion/contamination during a consolidation process, said method comprising the steps of:

providing a can having an inner wall;

lining said inner wall of said can with a protective layer formed from a material selected from the group consisting of a nickel alloy, a chrome alloy, and combinations thereof; wherein said lining comprises forming said lining on said inner wall using a sol-gel process utilizing monodisperse nanopowders;

placing a powdered nickel based superalloy material in said can so that said powdered nickel based superalloy material is in contact with said protective layer; and subjecting said can with said powdered nickel based superalloy material and said protective layer to a consolidation process.

2. The method of claim 1 wherein said can providing step comprises providing a can formed from a steel material.

3. The method of claim 1, wherein said powdered material placing step comprises placing a powdered nickel based superalloy material in said can.

4. The method of claim 1, wherein said lining step comprises lining said inner wall with a nickel alloy.

5. The method of claim 1, wherein said lining step comprises lining said inner wall with a chrome alloy.

* * * * *